US006347560B1

(12) United States Patent
Maezawa et al.

(10) Patent No.: US 6,347,560 B1
(45) Date of Patent: Feb. 19, 2002

(54) SHIFT CONTROL SYSTEM FOR A WORKING VEHICLE HAVING A PROPELLING STEPLESS TRANSMISSION

(75) Inventors: Kiyoshige Maezawa, Kishiwada; Kiyokazu Nakanishi, Kawachinagano; Tsukasa Wada, Sakai, all of (JP)

(73) Assignee: Kubota Corporation (JP)

( * ) Notice: Subject to any disclaimer, the term of this patent is extended or adjusted under 35 U.S.C. 154(b) by 0 days.

(21) Appl. No.: 09/516,571

(22) Filed: Mar. 1, 2000

(30) Foreign Application Priority Data

Sep. 16, 1999 (JP) ..... 11-262042

(51) Int. Cl.[7] ..... G05G 11/00; G05G 1/14

(52) U.S. Cl. ..... 74/473.16; 74/481

(58) Field of Search ..... 29/401.1; 74/473.16, 74/473.17, 481, 482

(56) References Cited

U.S. PATENT DOCUMENTS 4,059,025 A * 11/1977 Waack et al. ..... 74/482
4,341,129 A * 7/1982 Bando ..... 74/481
4,608,879 A 9/1986 Ishida et al. ..... 74/474
4,620,575 A * 11/1986 Cuba et al. ..... 74/481 X
5,263,385 A * 11/1993 Hirata et al. ..... 74/481

* cited by examiner

*Primary Examiner*—Allan D. Herrmann
(74) *Attorney, Agent, or Firm*—Webb Ziesenheim Logsdon Orkin & Hanson, P.C.

(57) ABSTRACT

A shift control system includes a shift pedal (13), a first linkage mechanism (16, 18, 19, 20) for transmitting a downward displacement of the shift pedal to the stepless transmission to change a shift position of the stepless transmission, a retaining mechanism (30, 40, 41, 42) for producing a retaining position corresponding to the shift position to retain the shift position of the stepless transmission, and a shift lever (26) for setting the retaining position retained by the retaining mechanism. A second linkage mechanism (34, 35, 36) is provided for transmitting of an operating displacement of the shift lever to the shift pedal to displace the shift pedal to a depressed position corresponding to the retaining position set by the shift lever and retained by the retaining mechanism. The shift lever, retaining mechanism and second linkage mechanism are attachable and detachable independently of the first linkage mechanism.

10 Claims, 12 Drawing Sheets

SHIFT CONTROL SYSTEM FOR A WORKING VEHICLE HAVING A PROPELLING STEPLESS TRANSMISSION

BACKGROUND OF THE INVENTION

1. Field of the Invention

This invention relates to a shift control system for a working vehicle having a propelling stepless transmission. More particularly, the invention relates to a shift control system having a shift pedal, a first linkage mechanism for transmitting a downward displacement of the shift pedal to the stepless transmission to change a shift position of the stepless transmission, a retaining mechanism for producing a retaining position corresponding to the shift position to retain the shift position of the stepless transmission, and a shift lever for setting the retaining position to be retained by the retaining mechanism.

2. Description of the Related Art

An agricultural tractor which is one example of working vehicles may include a hydrostatic stepless transmission for propelling the tractor. A shift pedal and the stepless transmission are interlocked through a linkage mechanism (e.g. a mechanical linkage mechanism with a linkage rod and the like for interlocking the shift pedal and stepless transmission, or an electric or hydraulic linkage mechanism for shifting the stepless transmission with an electric motor or hydraulic actuator in response to a control position of the shift pedal). The stepless transmission is shifted through the linkage mechanism in response to a depression of the shift pedal.

When the agricultural tractor engages in a grass cutting operation with a mower unit attached thereto, the grass cutting operation is carried out in many cases while running at a fixed speed. Thus, the agricultural tractor may include a retaining mechanism for retaining the stepless transmission in a desired shift position, and a shift lever for operating the retaining mechanism. The tractor can run at a fixed speed by operating the retaining mechanism with the shift lever to retain the stepless transmission in the desired shift position, without depressing the shift pedal. This is usually called a cruising function.

Two types of models may be manufactured as working vehicles such as agricultural tractors having a propelling stepless transmission, one with the above retaining mechanism and the other without it. The type with the retaining mechanism must have a construction for mechanically interlocking the retaining mechanism and stepless transmission so that the retaining mechanism is operable to retain the stepless transmission in a desired shift position.

Consequently, when manufacturing the type with the retaining mechanism, the construction of the type without the retaining mechanism (e.g. the linkage mechanism interlocking the shift pedal and stepless transmission) may be altered to mechanically interlock the retaining mechanism and stepless transmission) Then, productivity may be lowered in manufacturing the type with the retaining mechanism and the type without it.

SUMMARY OF THE INVENTION

An object of this invention is to provide a shift control system for a working vehicle having a propelling stepless transmission, which improves productivity in manufacturing the type of vehicle with a retaining mechanism for retaining the stepless transmission in a desired shift position, and the type having no such retaining mechanism.

To fulfilled the above object, this invention proposes a shift control system as set forth at the outset hereof, wherein a second linkage mechanism is provided for transmitting of an operating displacement of the shift lever to the shift pedal to displace the shift pedal to a depressed position corresponding to the retaining position set by the shift lever and retained by the retaining mechanism.

In a working vehicle having a propelling stepless transmission, for example, the shift pedal and stepless transmission may be interlocked through a first linkage mechanism. The stepless transmission is shiftable by a depression of the shift pedal through the first linkage mechanism. When adding a cruising function to such a working vehicle with a retaining mechanism provided for retaining in a desired shift position, and a shift provided for operating the retaining mechanism, the retaining mechanism and shift lever are mounted on a vehicle body, and the retaining mechanism and the shift pedal are interlocked through the second linkage mechanism. With this construction, by operating the shift lever, the shift pedal may be operated to and retained in a desired shift position through the retaining mechanism and second linkage mechanism. Through the shift pedal and first linkage mechanism, the stepless transmission may be retained in a desired shift position.

That is, when providing the retaining mechanism and shift lever for the vehicle body of the type of vehicle not having the retaining mechanism, it is necessary only to interlock the retaining mechanism and shift pedal through the second linkage mechanism. The type of vehicle having the retaining mechanism (i.e. the cruising function) may be obtained with little or no modification made to the first linkage mechanism interlocking the shift pedal and stepless transmission.

When manufacturing the type of vehicle with the retaining mechanism and the type of vehicle without it, the latter may be manufactured without modification, whereas the type with the retaining mechanism may be obtained by adding the retaining mechanism and shift lever to the vehicle body of the type not having the retaining mechanism, and interlocking the retaining mechanism and shift pedal through the second linkage mechanism.

In a preferred embodiment of this invention, the shift lever, retaining mechanism and second linkage mechanism are attachable and detachable independently of the first linkage mechanism. This construction realizes, in a simple way, the cruising type by incorporating the retaining mechanism as an option, and the non-cruising type by removing the retaining mechanism, which may be done at any time as desired.

In a preferred embodiment of this invention, the second linkage mechanism includes a play-accommodating mechanism for permitting a depression of the shift pedal to a higher speed position than the retaining position retained by the retaining mechanism, the play-accommodating mechanism permitting the shift pedal to be depressed the retaining position retained by the retaining mechanism to the higher speed position. With this construction, when the driver desires to temporarily accelerate the type of vehicle having the retaining mechanism and running with the shift pedal, and thus the stepless transmission, retained in a selected shift position by the retaining mechanism, the driver may cause the vehicle to run temporarily at high speed by depressing the shift pedal from the selected shift position to a higher speed position.

In another preferred embodiment of this invention, the retaining mechanism, shift lever and second linkage mechanism are mounted on a support member. The retaining mechanism, shift lever and second linkage mechanism by means of the support member constitute a single unit. To obtain the type of vehicle with the retaining mechanism, the support member may be attached to the vehicle body to incorporate the retaining mechanism, shift lever and second linkage mechanism into the vehicle body. There is no need to attach the retaining mechanism shift lever and second linkage mechanism individually to the vehicle body.

In a working vehicle having the stepless transmission is disposed between right and left body frames, and the shift pedal disposed laterally outwardly of the right body frame, and the first linkage mechanism extending through the right body frame for interlocking the shift pedal and stepless transmission, this invention proposes to interlock the retaining mechanism and shift pedal through the second linkage mechanism laterally outwardly of the right body frame. With this construction, when the retaining mechanism and shift lever are added to a vehicle body of the type having no retaining mechanism, the retaining mechanism and shift pedal may be interlocked easily through the second linkage mechanism laterally outwardly of the right body frame. The type of vehicle having the retaining mechanism may be obtained with little or no modification made to the first linkage mechanism interlocking the shift pedal and stepless transmission.

In a working vehicle such as an agricultural tractor, the stepless transmission is steplessly shiftable forward and backward, and the shift pedal may include a forward pedal portion extending forward, and a rearward pedal portion extending rearward, the forward pedal portion being depressible to shift the stepless transmission for high forward speed, the rearward pedal portion being depressible to shift the stepless transmission for high backward speed. For such a working vehicle, this invention proposes to dispose the retaining mechanism rearwardly of the shift pedal, and to interlock the retaining mechanism and the rearward pedal portion through the second linkage mechanism. Since the retaining mechanism is disposed close to the shift pedal according to this construction, the retaining mechanism and shift pedal may be interlocked easily through the second linkage mechanism. The second linkage mechanism may be reduced in length.

Other features and advantages of this invention will be apparent from the following description of the embodiments to be taken with reference to the drawings.

DESCRIPTION OF THE PREFERRED EMBODIMENTS

Figure 1:
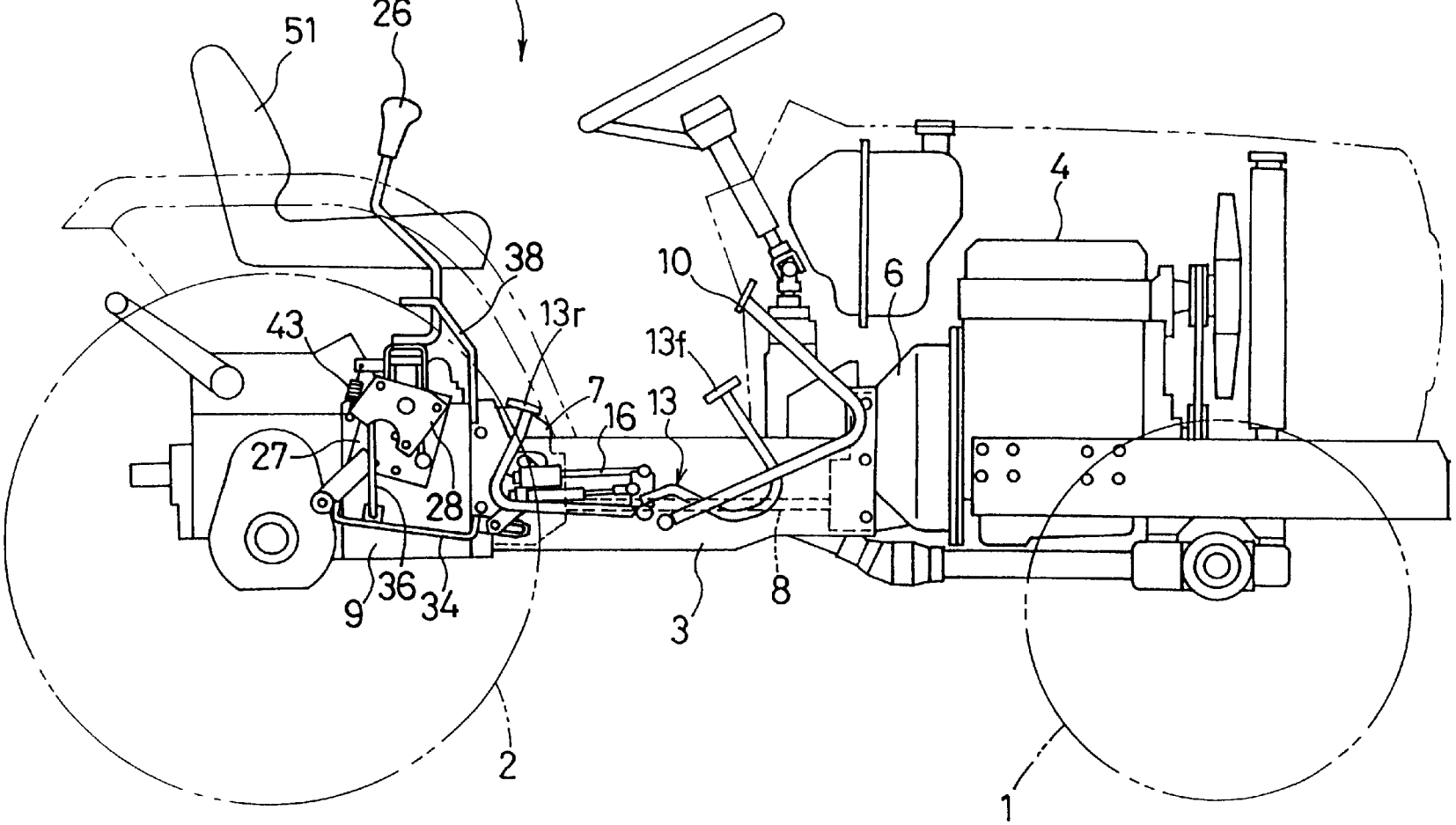
FIG. 1 is a side elevation of an agricultural tractor.

FIG. 1 shows an agricultural tractor which is one example of working vehicles. This tractor includes a pair of right and left front wheels 1, an engine 4 and a clutch 6 arranged on a forward portion of a vehicle body, and a pair of right and left rear wheels 2 and a transmission case 9 arranged on a rearward portion of the vehicle body. The clutch 6 and transmission case 9 are interconnected through a pair of right and left body frames 3 consisting of vertical plates. The right and left body frames 3 are in the form of a tube having a square section with a top plate (not shown) and a bottom plate (not shown) connected thereto. A driving platform 5 is formed on the body frames 3.

Figure 2:
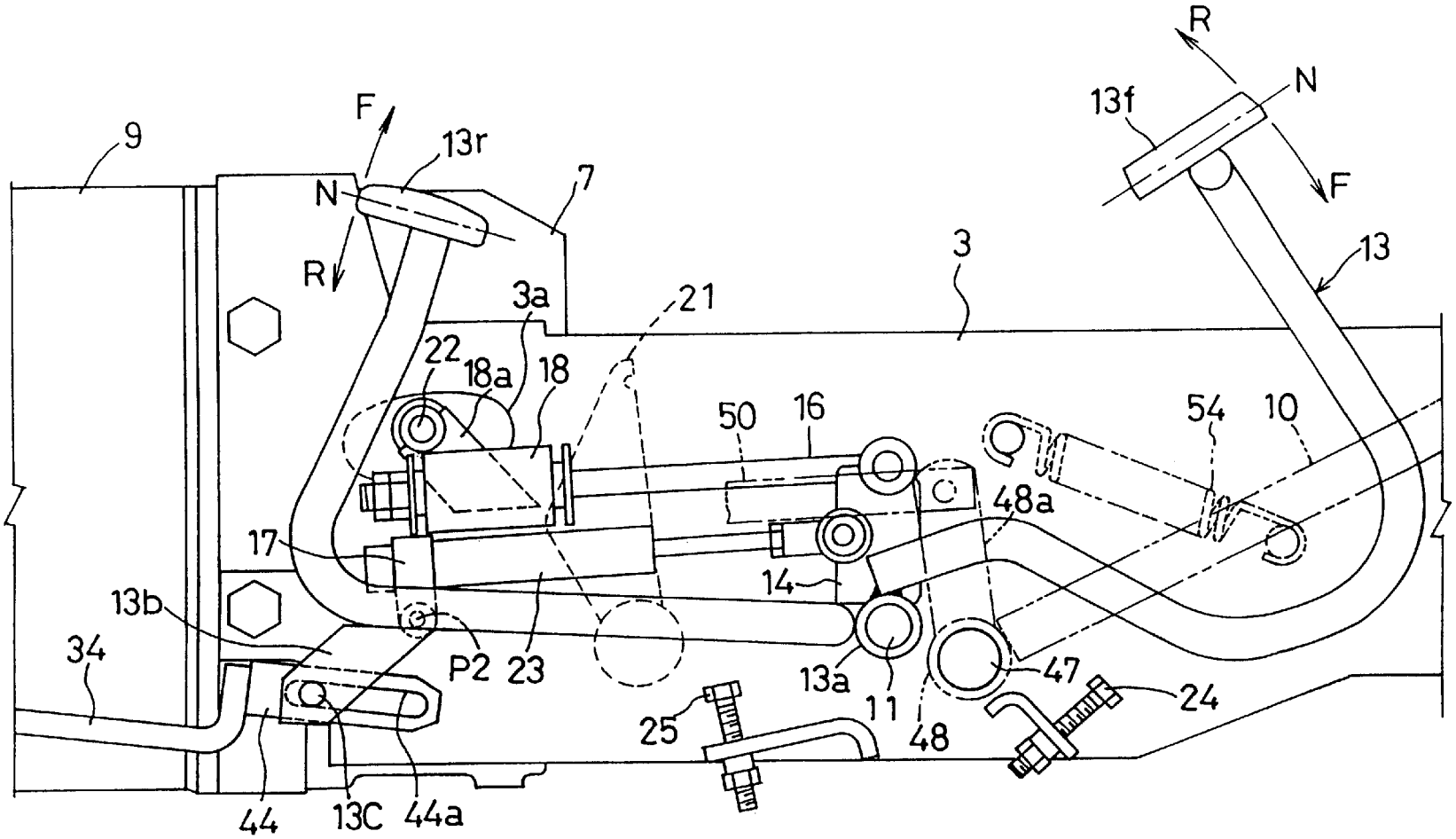
FIG. 2 is a side view of a shift pedal and adjacent components.

As shown in FIGS. 1 and 2, a hydrostatic stepless transmission 7 shiftable forward F and backward R is disposed between the right and left body frames 3 and connected to the front of transmission case 9. A transmission shaft 8 also disposed between the right and left body frames 3 transmits power from the clutch 6 to the stepless transmission 7.

A shift pedal 13 for shifting the stepless transmission 7 forward F and backward R will be described next.

As shown in FIGS. 1 and 2, the shift pedal 13 is pivotable about a support shaft 11 fixed to an outer side wall of the right body frames 3. The shift pedal 13 includes a boss 13*a* rotatably mounted on the support shaft 11, a forward pedal portion 13*f* fixed to the boss 13*a* and extending forward of the vehicle body, and a rearward pedal portion 13*r* fixed to the boss 13*a* and extending rearwardly of the vehicle body.

Figure 3:
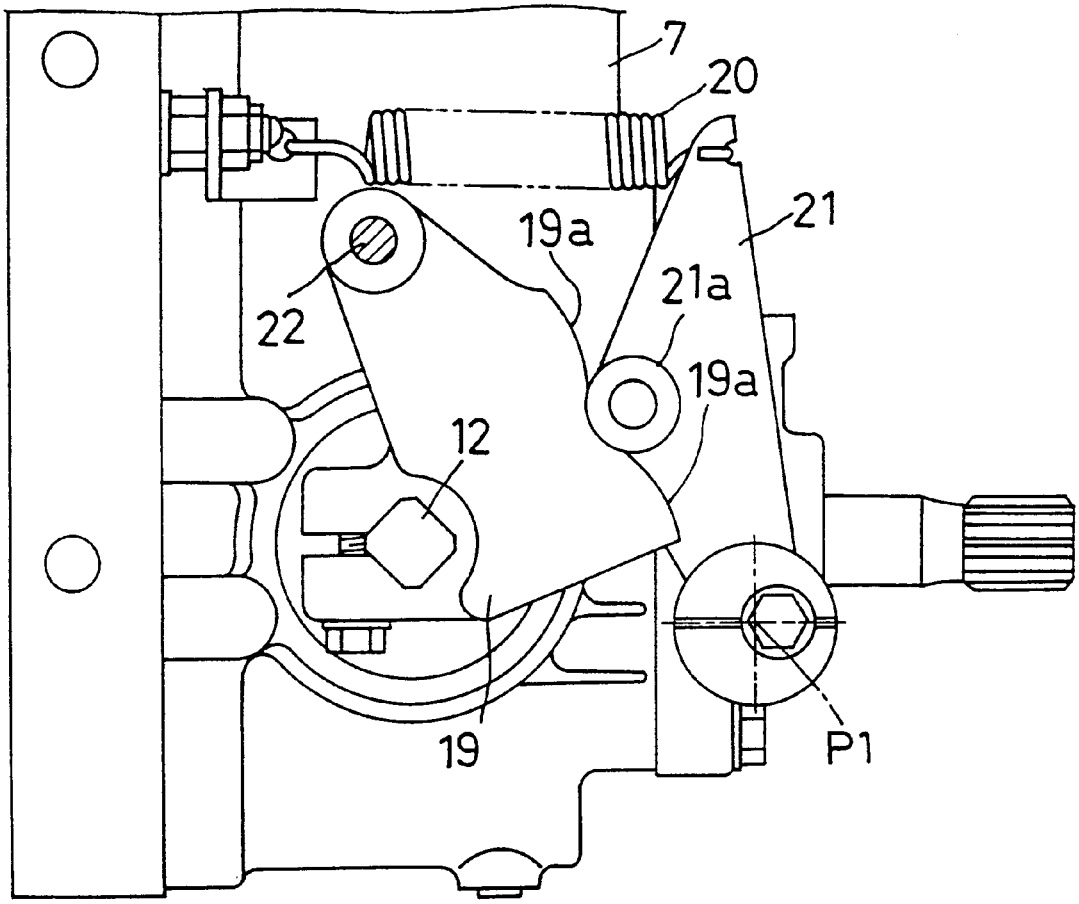
FIG. 3 is a side view of a trunnion and adjacent components of a stepless transmission.
Figure 4:
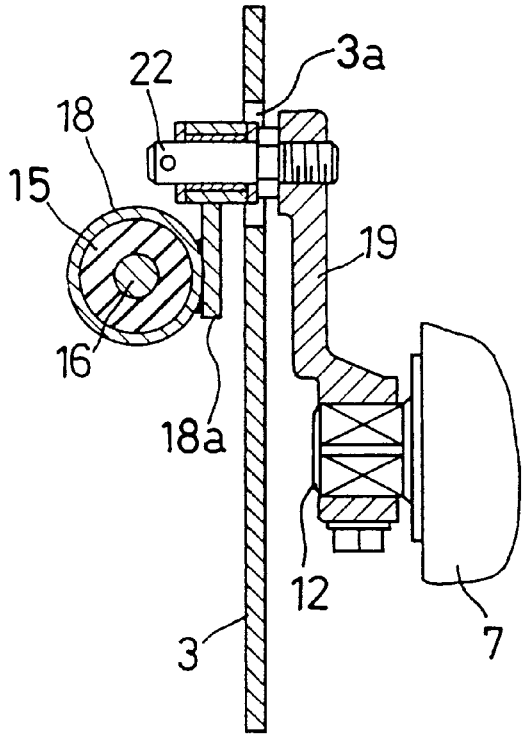
FIG. 4 is a front view in vertical section of the trunnion and adjacent components of the stepless transmission.
Figure 5:
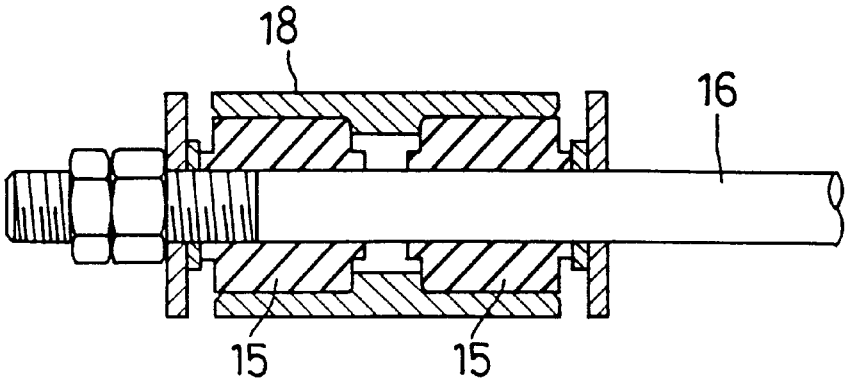
FIG. 5 is a side view in vertical section of a boss of a linkage rod interlocking the stepless transmission (trunnion) and the shift pedal.

As shown in FIGS. 2, 3 and 4, a control arm 19 is fixed to a trunnion 12 of stepless transmission 7 between the right and left body frames 3. The control arm 19 has a control shaft 22 projecting laterally outwardly from the right body frame 3 through a bore 3*a* formed therein. As shown in FIGS. 2, 3 and 4, a control arm 14 is fixed to the boss 13*a*, and a linkage rod 16 is connected to the control arm 14. Rubber cushions 15 as shown in FIG. 5 are mounted on an end portion of linkage rod 16. A boss member 18 fitted on the rubber cushions 15 has a coupling 18*a* connected to the control shaft 22.

As shown in FIGS. 2 and 3, an arm 21 is supported to be pivotable about a transverse axis P1 of stepless transmission 7 between the right and left body frames 3. The arm 21 has a roller 21*a*. The arm 21 is biased counterclockwise in FIG. 3 by a spring 20 to press the roller 21*a* against a V-shaped cam 19*a* formed on the control arm 19. As shown in FIG. 2, a bracket 17 is supported to be pivotable about a transverse axis P2 on the outer side wall of the right body frame 3, and a damper 23 is connected between the bracket 17 and control arm 14. Further, the right body frame 3 supports, fixed to the outer side wall thereof, a stopper 24 for setting a limit to depression of the forward pedal portion 13*f*, and a stopper 25 for setting a limit to depression of the rearward pedal portion 13*r*.

With the above construction, when the forward pedal portion 13*f* is depressed, an operating force is transmitted through the linkage rod 16 to shift the stepless transmission 7 (trunnion 12) forward F to a high speed position. When the rearward pedal portion 13*r* is depressed, an operating force is transmitted through the linkage rod 16 to shift the stepless transmission 7 (trunnion 12) backward R to a high speed position. A rapid depression of forward or rearward pedal portion 13*f* or 13*r* is eased by the damper 23. The arm 21 constantly biases the stepless transmission 7 (trunnion 12) and shift pedal 13 to neutral position N. The rubber cushions 15 prevent vibration of stepless transmission 7 (trunnion 12) from being transmitted to the shift pedal 13. Thus, in this embodiment, the linkage rod 16, boss member 18, control arm 19 and control shaft 22 constitute a first linkage mechanism for transmitting a downward displacement of the shift pedal 13 to the stepless transmission 7 (trunnion 12) to change a shift position of stepless transmission 7 (a turning angle of trunnion 12).

A structure for retaining the shift pedal 13 and stepless transmission 7 in a desired shift position forward F set by a shift lever 26, i.e. a retaining mechanism, will be described next.

Figure 6:
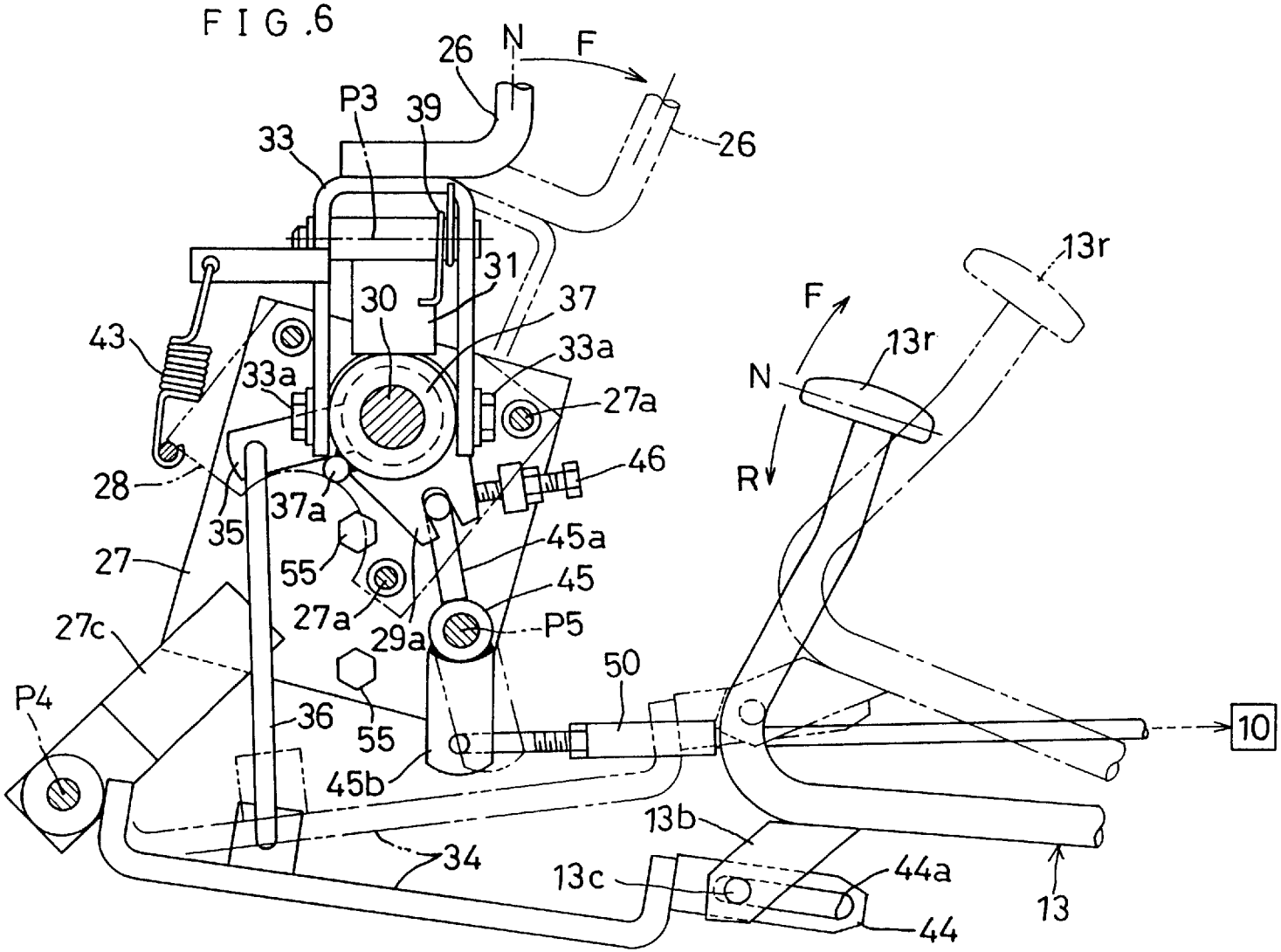
FIG. 6 is a side view in vertical section of a shift lever for retaining the shift pedal (stepless transmission) in a desired shift position.
Figure 7:
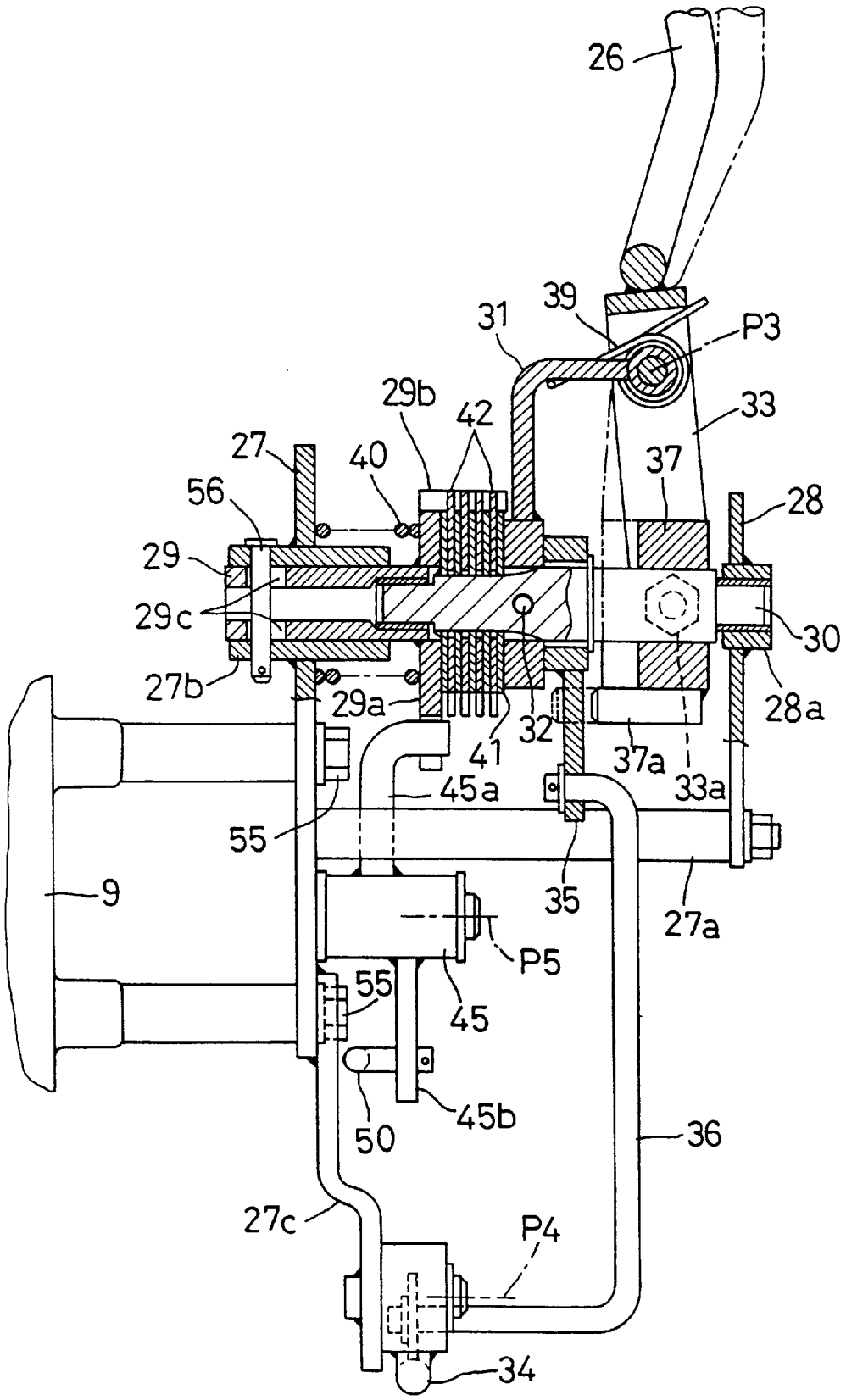
FIG. 7 is a rear view in vertical section of the shift lever for retaining the shift pedal (stepless transmission) in a desired shift position.

As shown in FIGS. 6 and 7, a planar support member 27 shaped rectangular in side view is provided, and a support plate 28 is fixed to support rods 27*a* fixed to the support member 27. A cam boss member 29 is supported by a boss 27*b* of support member 27 to be rotatable within a predetermined angular range as described later. An end of a control shaft 30 is rotatably supported by a boss 28*a* of support plate 28. The other end of control shaft 30 is rotatably supported by the cam boss member 29.

A linkage arm 34 is supported to be pivotable about a transverse axis P4 of a support arm 27*c* fixed to the support member 27. A bracket 44 with a slot 44*a* is fixed to a distal end of linkage arm 34. A control arm 35 is relatively rotatably mounted on the control shaft 30. A linkage rod 36 is connected between the control arm 35 and linkage arm 34. As described later, a pin 13*c* of a bracket 13*b* fixed to the rearward pedal unit 13*r* is inserted into the slot 44*a* of bracket 44 to interlock the linkage arm 34 and rearward pedal unit 13*r*.

A support member 31 L-shaped in front view is fixed by a spring pin 32 mounted on the control shaft 30. A control arm 33 U-shaped in side view is supported to be pivotable about a fore and aft axis P3 at an upper end of support member 31. The shift lever 26 is fixed to the support member 31. A ring 37 with a pin 37*a* is slidably mounted on the control shaft 30. The control arm 33 has a pin 33*a* thereof engaged with the ring 37. A spring 39 biases the shift lever 26 and control arm 33 counterclockwise in FIG. 7 (in a direction to move the pin 37*a* away from the control arm 35). A spring 43 is connected between the support plate and control arm 33 to bias the shift lever 26 to a neutral position N in a lever guide 38 (FIG. 9).

Figure 9:
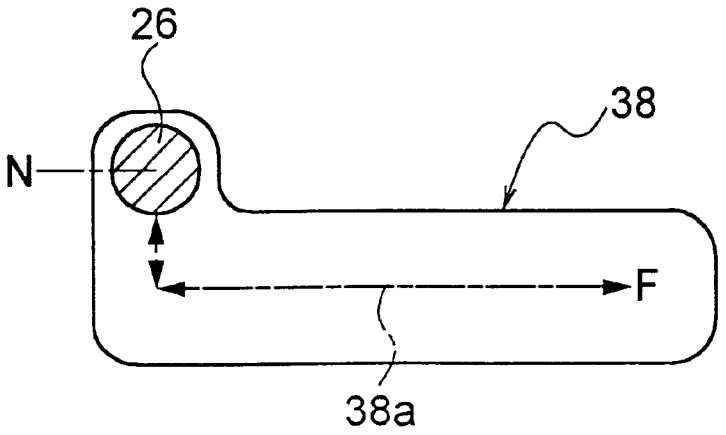
FIG. 9 is a plan view of a lever guide of the shift lever.

In the state shown in FIGS. 6, 7 and 9, the shift lever 26 is operated to neutral position N of lever guide 38. The pin 37*a* is moved rightward FIG. 7 away from the control arm 35. When, in this state, the shift lever 26 is operated from the neutral position N to a forward shifting path 38*a* along the lever guide 38, the control arm 33 slides the ring 37 and pin 37*a* leftward in FIG. 7. Then the pin 37*a* contacts the control arm 35 from below. When, in this state, the shift lever 26 is operated along the forward shifting path 38*a*, the shift lever 26 rotates the control shaft 30 and pin 37*a* together. The pin 37*a* rotates the control arm 35 with the control shaft 30.

As shown in FIG. 7, the control shaft 30 has splines formed on a leftward portion in FIG. 7. A plurality of first friction plates 41 are mounted on the splines of control shaft 30 to be rotatable with the control shaft 30. A plurality of second friction plates 42 are arranged between the first friction plates 41 to be rotatable relative to the control shaft 30. One end of each second friction plate 42 is engaged with a pin 29*b* of a cam plate 29*a* fixed to the cam boss member 29, whereby the second friction plates 42 are fixed to the cam plate 29*a*. A spring 40 is provided for pressing the cam plate 29*a*.

Figure 8:
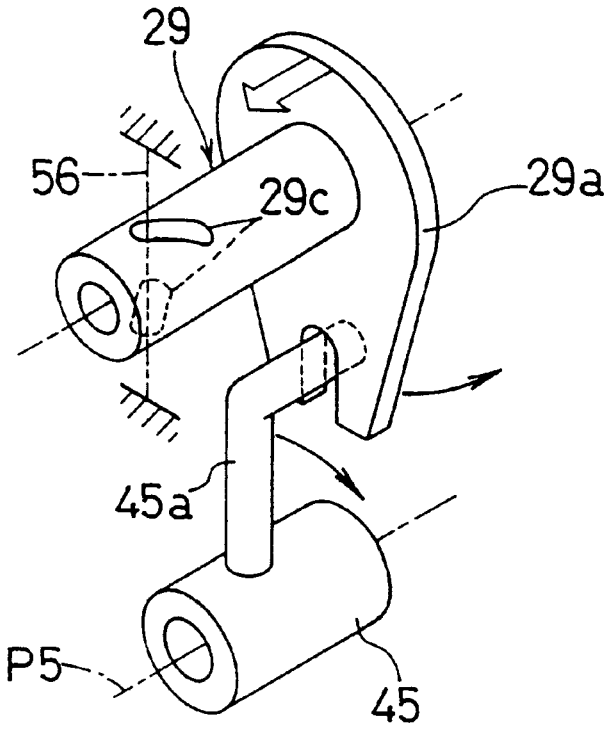
FIG. 8 is a perspective view of a cam plate for retaining the shift lever.

As shown in FIGS. 6, 7 and 8, a boss member 45 is supported to be rotatable about a transverse axis P5 of support member 27. The boss member 45 has a first arm 45*a* engaged with the cam plate 29*a*. The support member 27 has a stopper 46 for stopping rotation of the cam plate 29*a* counterclockwise from the position shown in FIG. 8. The cam plate 29*a* is fixed to the position shown in FIGS. 6 and 7, by interlocking between a second arm 45*b* of boss member 45 and side brake pedals 10 as described later, and by the stopper 46.

Figure 10A:
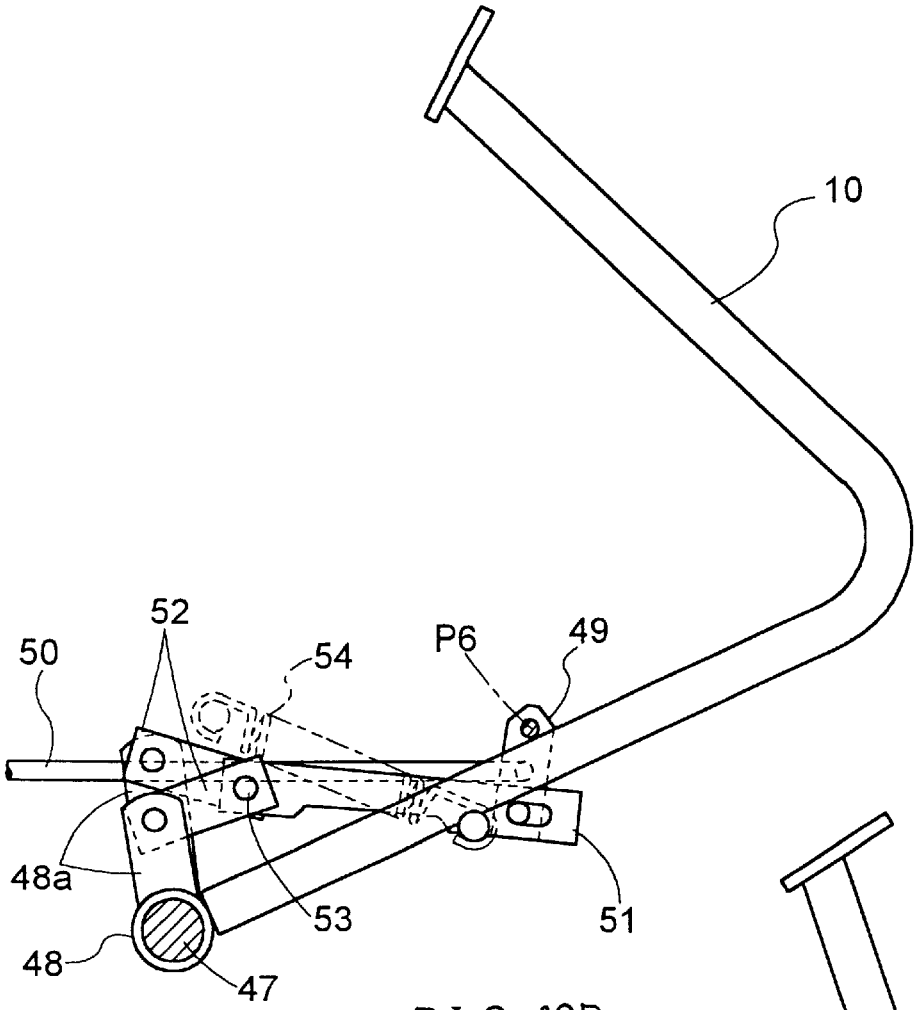
FIGS. 10A and 10B are side views of right and left side brake pedals both in a depressed state.

As shown in FIGS. 2 and 10A, a support shaft 47 is fixed to the outer wall of the right body frame 3, and a pair of bosses 48 are rotatably arranged on the support shaft 47. Right and left side brake pedals 10 are fixed to the right and left bosses 48. Right and left side brakes (not shown) are provided for braking the right and left rear wheels 2 independently of each other. The right side brake pedal 10 is mechanically interlocked to the right side brake. The left side brake pedal 10 is mechanically interlocked to the left side brake. A spring 54 is provided for biasing and returning the right and left side brake pedals 10.

As shown in FIG. 10A, a control arm 49 is supported to be pivotable about a transverse axis P6 on the right body frame 3. As shown in FIGS. 6 and 7, a linkage rod 50 is connected between the second arm 45*b* of boss member 45 and the control arm 49. As shown in FIG. 10A, the right and left bosses 48 have arms 48*a* of different lengths. A link 51 connected to the control arm 49 is connected through a pair of links 52 and a pin 53 to the arms 48*a* of right and left bosses 48.

In this embodiment, as will be appreciated from the above description, the control shaft 30, spring 40 and first and second friction plates 41 and 42 constitute a retaining mechanism for producing a retaining position corresponding to a shift position (a rotating angle of trunnion 12) in which the stepless transmission 7 is to be retained. In this embodiment, the linkage arm 34, control arm 35 and linkage rod 36 constitute a second linkage mechanism for transmitting a displacement of the shift lever 26 to the shift pedal 13 in order to displace the shift pedal 13 to a depressed position corresponding to the retaining position set by the shift lever 26 and retained by the retaining mechanism.

As seen FIGS. 1, 6 and 7, the shift lever 26, retaining mechanism and second linkage mechanism, i.e. the shift lever 26, control shaft 30, cam plate 29*a*, spring 40, first and second friction plates 41 and 42, linkage arm 34, control arm 35 and linkage rod 36 constitute a single unit independent of the first linkage mechanism and supported by the support member 27.

Thus, when manufacturing the type of vehicle with no mechanism for retaining the shift pedal 13 and stepless transmission 7 in a desired shift position forward F set by the shift lever 26, the above unit is not provided for the vehicle body, and the lever guide 38 is omitted also. The control arm 49, linkage rod 50, link 51 or 52 or pin 53 shown in FIG. 10A is not provided either. (The bosses 48 shown in FIG. 19A may be replaced with bosses 48 not having arms 48*a*.)

Next, when manufacturing the type of vehicle with the mechanism for retaining the shift pedal 13 and stepless transmission 7 in a desired shift position forward F set by the shift lever 26, i.e. the cruising mechanism, as shown in FIG. 1, 6 and 7, the unit is disposed rearwardly of the shift pedal 13, the support member 27 is fixed to the vehicle body with bolts 55, the lever guide 38 placed in position, and the pin 13*c* of bracket 13*b* of rearward pedal portion 13*r* is inserted through the slot 44*a* of bracket 44 to interlock the linkage arm 34 and rearward pedal portion 13*r*.

As shown in FIG. 10A, the control arm 49, linkage rod 50, links 51 and 52 and pin 53 are attached. As shown in FIGS. 6 and 7, the linkage rod 50 is connected to the second arm 45*b* of boss member 45.

In the state shown in FIGS. 6, 7 and 9, the shift lever 26 is operated to the neutral position N of lever guide 38. The first and second friction plates 41 and 42 are pressed by the biasing force of spring 40 to retain the shift lever 26 in the neutral position N with the frictional force. The ring 37 and pin 37*a* are slid by the control arm 33 rightward in FIG. 7, with the pin 37*a* lying away from the control arm 35.

When, in this state, the forward pedal portion 13*f* is depressed, the stepless transmission 7 (trunnion 12) is shifted forward F to a high speed position. The rearward pedal portion 13*r* causes the linkage arm 34 to pivot upward about the transverse axis P4. The linkage rod 36 causes the control arm 35 to pivot clockwise of FIG. 6 about the control shaft 30. When the rearward pedal portion 13*r* is depressed, the stepless transmission 7 (trunnion 12) is shifted backward R to a high speed position. The rearward pedal portion 13*r* causes the linkage arm 34 to pivot downward about the transverse axis P4. The linkage rod 36 causes the control arm 35 to pivot counterclockwise of FIG. 6 about the control shaft 30.

Next, when the shift lever 26 is operated from the neutral position N to a high speed position along the forward shifting path 38*a*, the control arm 33 slides the ring 37 and pin 37*a* leftward in FIG. 7. Then the pin 37*a* contacts the control arm 35 from below. In this state, the first and second friction plates 41 and 42 remain pressed by the biasing force of spring 40 to apply the frictional force to the shift lever 26. As the shift lever 26 is operated along the forward shifting path 38*a* to the high speed position against the frictional force, the shift lever 26 rotates the control shaft 30 and pin 37*a* together clockwise in FIG. 6. The pin 37*a* rotates the control arm 35 with the control shaft 30 clockwise in FIG. 6. As a result, the linkage rod 36 causes the linkage arm 34 to pivot upward about the transverse axis P4 to swing the rearward pedal portion 13*r* upward. The shift pedal 13 and stepless transmission 7 (trunnion 12) are operated to the high speed position forward F as when the forward pedal portion 13*f* is depressed.

Conversely, when the shift lever 26 is operated toward a low speed position (toward the neutral position N) along the forward shifting path 38*a* against the frictional force, the pin 37*a* is swung counterclockwise in FIG. 6 to move away from the control arm 35. The stepless transmission 7 (trunnion 12) and shift pedal 13 are biased to the neutral position N by the arm 21 shown in FIG. 3. Therefore, when the shift lever 26 is operated toward the low speed position (toward the neutral position N) along the forward shifting path 38*a* against the frictional force, the shift pedal 13 and stepless transmission 7 (trunnion 12) is shifted to a low speed position forward F, following the rotation of pin 37*a*.

Even when the operator releases the shift lever 26 in a desired shift position after shifting the shift pedal 13 and stepless transmission 7 (trunnion 12) to a high speed position or low speed position forward F with the shift lever 26, the shift lever 26 is retained to the desired shift position by a frictional force produced by the spring 40 and first and the second friction plates 41 and 42. Consequently, the shift pedal 13 and stepless transmission 7 (trunnion 12) are retained in a desired shift position forward F by the action of arm 21 shown in FIG. 3 to bias the stepless transmission 7 (trunnion 12) and shift pedal 13 to the neutral position N and by the pin 37*a*. The lever guide 38 has no backward shifting path, and the shift pedal 13 and stepless transmission 7 (trunnion 12) cannot be shifted backward R with the shift lever 26.

When, in this state, the tractor runs temporarily at high speed, the forward pedal portion 13*f* may be depressed. When the forward pedal portion 13*f* is depressed, the control arm 35 pivots clockwise in FIG. 6 away from the pin 37*a*. Thus the forward pedal portion 13*f* may be depressed with no problem. When the operator removes the foot from the forward pedal portion 13*f*, the control arm 35 is returned into contact with the pin 37*a* by the action of arm 21 shown in FIG. 3 which biases the stepless transmission 7 (trunnion 12) and shift pedal 13 to the neutral position N. The shift pedal 13 and stepless transmission 7 (trunnion 12) return to the state retained in the desired shift position forward F.

As shown in FIGS. 6, and 8, the first arm 45*a* of boss member 45 is engaged with the cam plate 29*a*. The second arm 45*b* of boss member 45 is interlocked to the side brake pedals 10 through the linkage rod 50 as shown in FIG. 10A. The stopper 46 acts on the cam plate 29*a*. All these features prevent rotation of the cam plate 29*a* when the shift lever 26 is operated against the frictional force. The frictional force is thus steadily applied to the shift lever 26.

Assume that the right and left side brake pedals 10 are both depressed in the state noted above where the shift pedal 13 and stepless transmission 7 (trunnion 12) are retained in a desired shift position forward F.

Figure 10B:
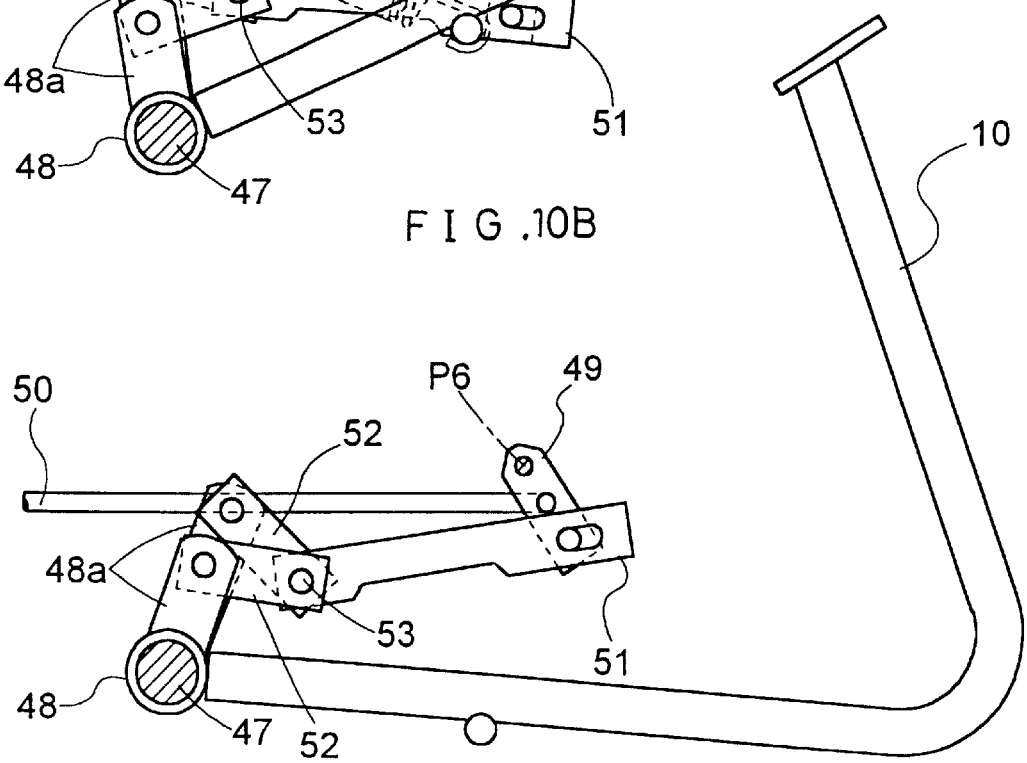
Figure 11A:
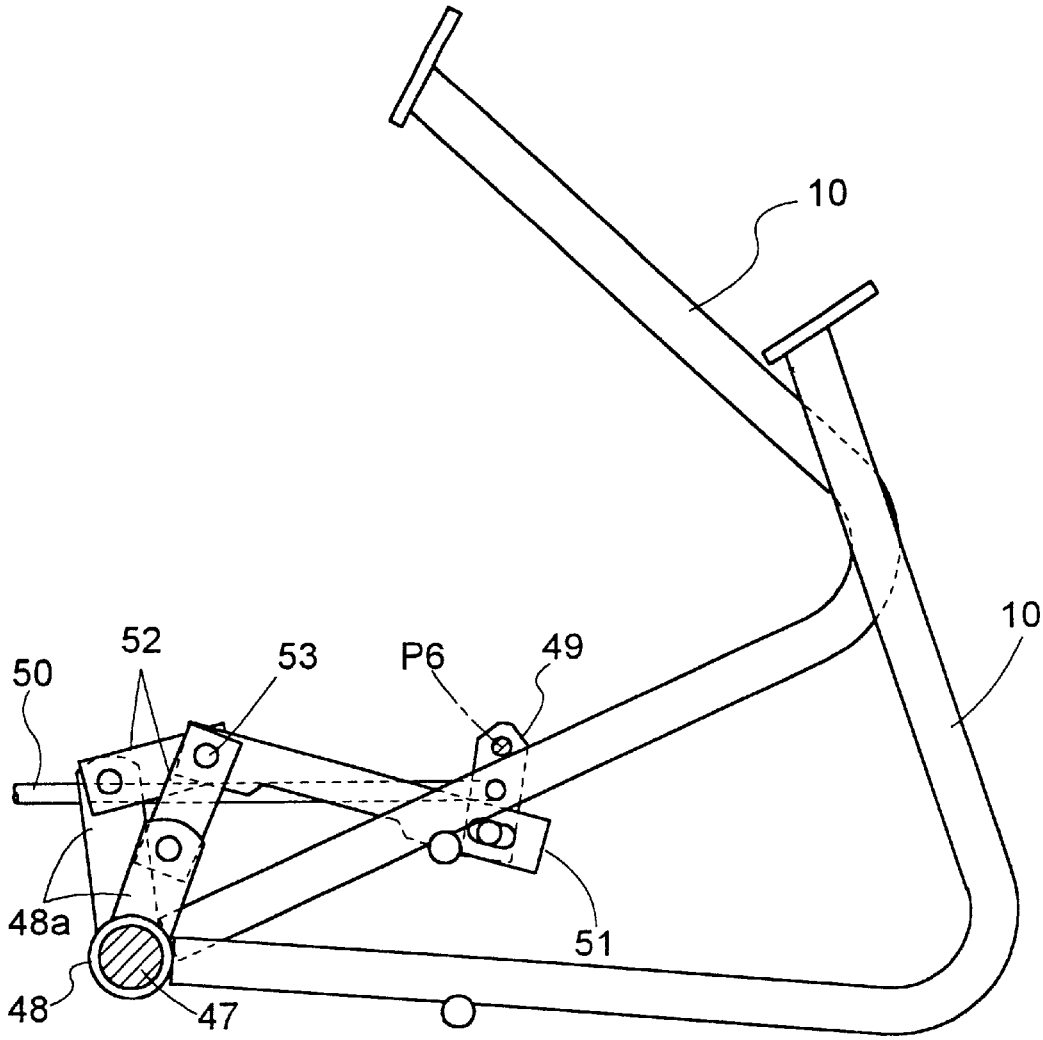
FIGS. 11A and 11B are side views of the right and left side brake pedals, showing a state where only the right side brake pedal is depressed and a state where only the left side brake pedal is depressed.
Figure 11B:
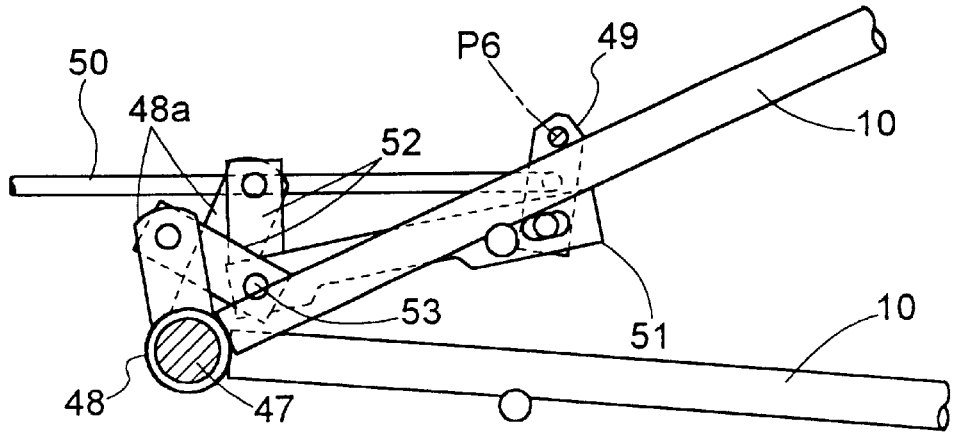

When the right and left side brake pedals 10 are both depressed, as shown in FIGS. 10A and 10B, the pair of links 52 and pin 53 move rightward in the drawings, and the link 51 swings the control arm 49 to pull the linkage rod 50 toward the control arm 49. Then, the boss member 45 and first arm 45*a* are rotated counterclockwise in FIG. 6, to rotate the cam plate 29*a* a predetermined angle clockwise in FIG. 6.

As shown in FIGS. 7 and 8, the cam boss member 29 defines a slot 29*c* extending obliquely, and the boss 27*b* has a pin 56 inserted through the slot 29*c* of cam boss member 29. When the cam plate 29*a* is rotated a predetermined angle clockwise in FIG. 6 as noted above, the camming action of the pin 56 of boss 27*b* and the slot 29*c* of cam boss member 29 moves cam plate 29*a*, against the force of spring 40, leftward in FIG. 7 away from the first and second friction plates 41 and 42. This eliminates the frictional force for retaining the shift lever 26 in the desired shift position. As a result, the shift lever 26 is returned to the neutral position N of lever guide 38 by the biasing force of spring 43 shown in FIG. 6. The shift pedal 13 and stepless transmission 7 (trunnion 12) are returned to the neutral position N by the action of arm 21 shown in FIG. 3 which biases the stepless transmission 7 (trunnion 12) and shift pedal 13 to the neutral position N.

Assume that one of the right and left side brake pedals 10 is depressed in the state where the shift pedal 13 and stepless transmission 7 (trunnion 12) are retained in a desired shift position forward F.

When the right side brake pedal 10 is depressed, as shown FIGS. 10A to 10B, only the right boss 48 and arm 48*a* are rotated clockwise, and the link 51 and the pair of links 52 are only bent upward about the pin 53. The control arm 49 is not swung at all. When the left side brake pedal 10 is depressed, as shown FIGS. 10A to 11B, only the left boss 48 and arm 48*a* are rotated clockwise, and the link 51 and the pair of links 52 are only bent downward about the pin 53. The control arm 49 is not swung at all. Thus, when one of the right and left side brake pedals 10 is depressed, the frictional force for retaining the shift lever 26 in the desired shift position is never eliminated, and the shift lever 26 remains in the desired shift position.

Modifications of the Above Embodiment

In the construction shown in FIGS. 2 and 4, the bore 3*a* formed in the right vehicle body frame 3 may be eliminated, and the linkage rod 16, damper 23 and control arm 14 may be arranged between the right and left body frames 3. The shift pedal 13 disposed laterally outwardly of the right body frame 3 and the control arm 14 disposed between the right and left body frames 3 may be connected to each other by an interlocking shaft (not shown) rotatably extending through the right body frame 3.

In the construction shown in FIGS. 1 and 2, the right and left body frames 3 formed of vertical plates may be replaced with right and left body frames 3 formed of a plurality of square pipe frames arranged at the right side with a predetermined vertical spacing therebetween, and a plurality of square pipe frames arranged at the left side with the predetermined vertical spacing therebetween. With this construction, the linkage rod 16 and the like are disposed to extend through the spacing between the upper and lower frame of the right body frame 3.

The hydrostatic stepless transmission 7 may be replaced with a belt type stepless transmission (not shown). The hydrostatic stepless transmission 7 or belt type stepless transmission may be disposed in a forward region the vehicle body.

Different Embodiment

Figure 12:
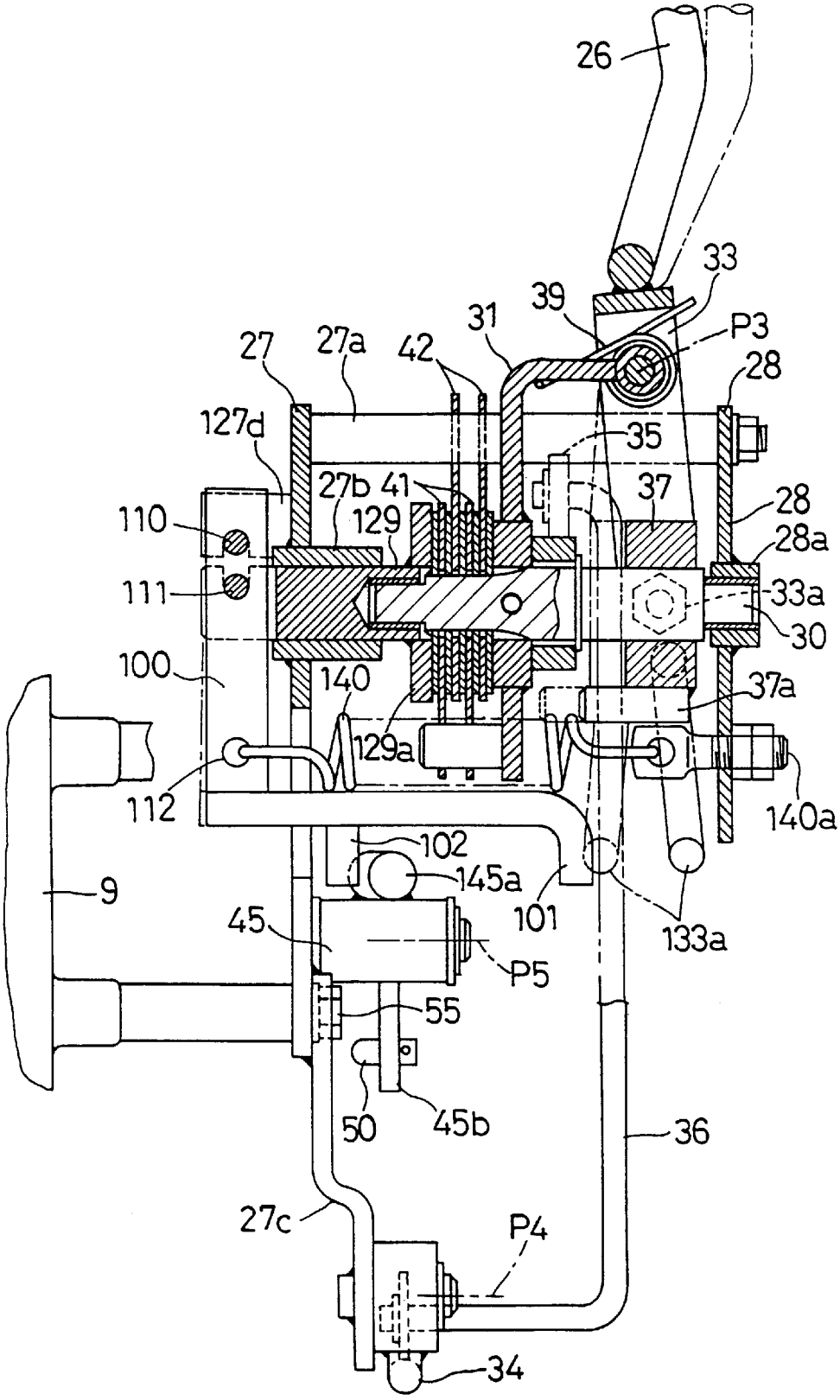
FIG. 12 is a side view in vertical section of a retaining mechanism in a different embodiment.
Figure 13:
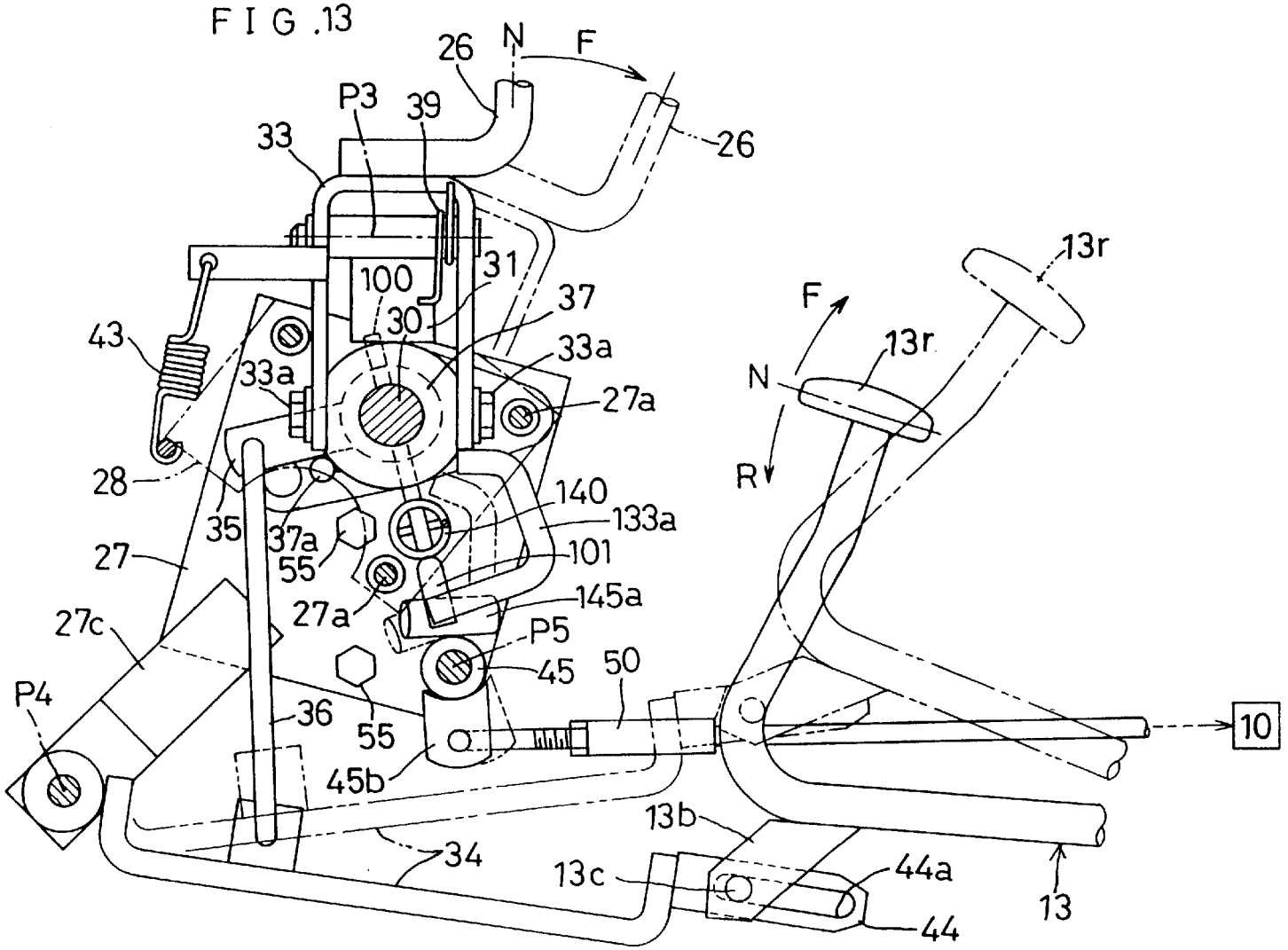
FIG. 13 is a rear view in vertical section of the retaining mechanism in the different embodiment.
Figure 14:
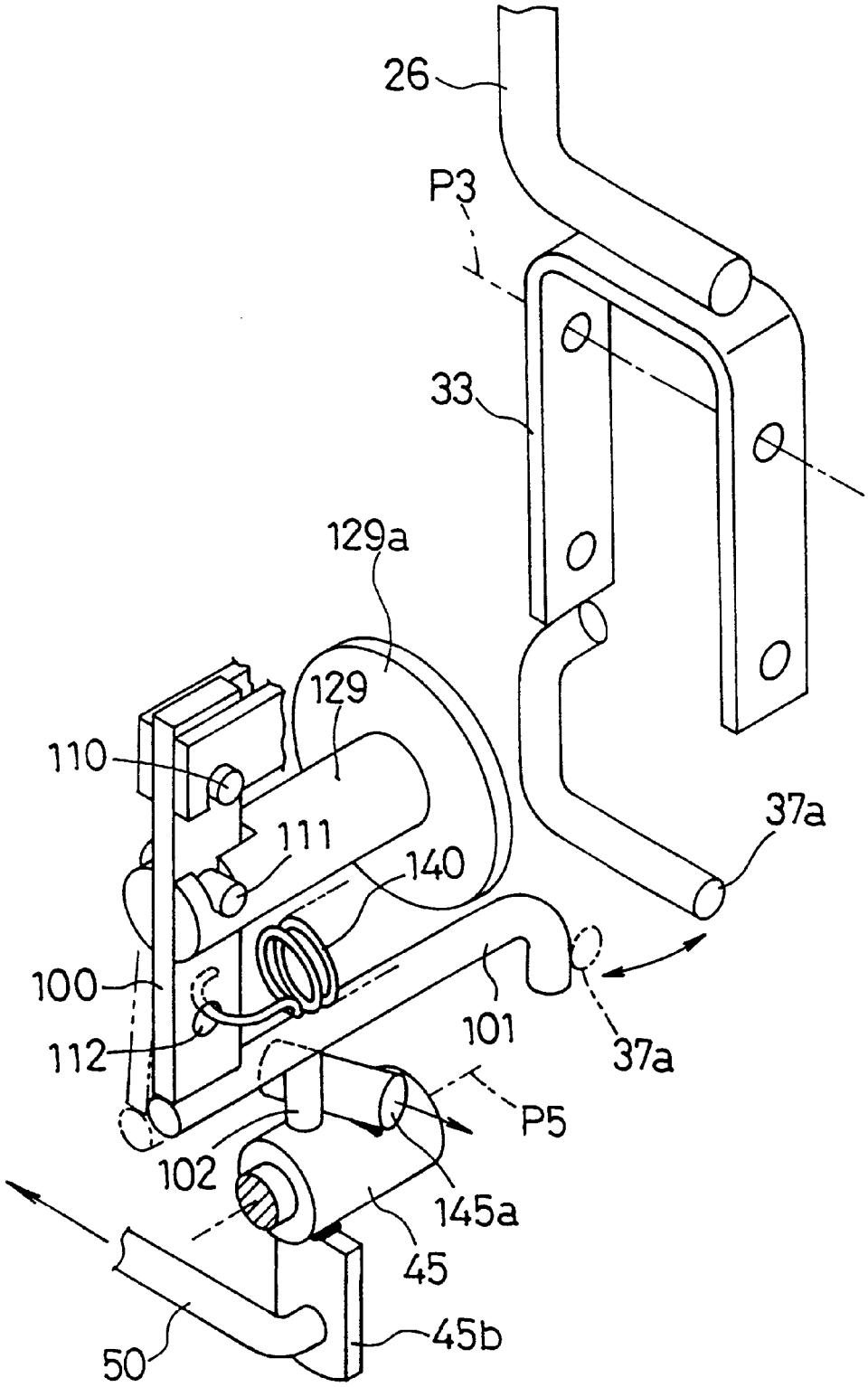
FIG. 14 is a perspective view of a cam mechanism for releasing the retaining mechanism in response to an operation of a side brake pedal.

A different structure of the retaining mechanism for retaining the shift pedal 13 and stepless transmission 7 in a desired shift position forward F set by the shift lever 26 will be described next with reference to FIGS. 12, 13 and 14. Parts identical to those of the foregoing embodiment are shown with the same reference numerals, and are not particularly described again.

In this embodiment, the spring for pressing the first and second friction plates 41 and 42 is changed from the compression spring 40 to a tension spring 140. Specifically, a pivotable plate 100 having a pivot pin 110 is provided to be pivotable about a downwardly opening U-shaped cutout formed in a bracket 127*d* attached to the support member 27. The pivotable plate 100 has a connecting pin 111 disposed at a small distance from the pivot pin 110, and a connecting bore 112 disposed at a large distance from the pivot pin 110. The connecting pin 111 is engaged with an upwardly opening U-shaped cutout defined adjacent a free end of a cam boss member 129. The connecting bore 112 has, attached thereto, one end of the tension spring 140 extending parallel to the axis of cam boss member 129. The other end of tension spring 140 is attached to a bore of a spring mounting member 140*a* bolted to the support plate 28. Thus, the first and second friction plates 41 and 42 are constantly pressed by the tension spring 140 through a cam plate 129*a* of cam boss member 129.

The pivotable plate 100 has, fixed to a free end thereof, an extension rod 101 extending parallel to the axis of cam boss member 129. The forward end of extension rod 101 defines a right-angled bent portion. When the control arm 33 pivots slightly about the axis P3 clockwise in FIG. 12, the bent portion contacts a push arm 133*a* extending downward from the lower end of control arm 33, to push the 133*a* leftward in FIG. 12 against the biasing force of tension spring 140. When the shift lever 26 is moved along the forward shifting path 38*a* of lever guide 38, the frictional retaining force of the first and second friction plates 41 and 42 is reduced only by slightly rocking the shift lever 26 about the axis P3. This lightens the shifting operation.

The following construction is provided for releasing the above retaining mechanism in response to an operation of the side brake pedals 10. The boss member 45 supported to be rotatable about a transverse axis P5 of support member 27 has a cam rod 145*a* attached the an outer peripheral surface thereof and extending obliquely to the transverse axis P5. A cam follower rod 102 extends downward from the extension rod 101 for contacting the peripheral surface of cam rod 145. The cam rod 145*a* is inclined relative to the transverse axis P5 by such a degree that the cam rod 145*a* displaces the cam follower rod 102 leftward in FIG. 12 in response to a pivotal movement of boss member 45 caused by the operation of side brake pedals 10. Consequently, when the side brake pedals 10 are operated, the pivot plate 100 swings clockwise in FIG. 12, thereby moving the cam boss member 129 leftward to release the first and second friction plates 41 and 42.

What is claimed is:

1. A shift control system for a working vehicle having a propelling stepless transmission, comprising:

a shift pedal;

a first linkage mechanism for transmitting a downward displacement of said shift pedal to said stepless transmission to change a shift position of said stepless transmission;

a retaining mechanism for producing a retaining position corresponding to said shift position to retain said shift position of said stepless transmission;

a shift lever for setting said retaining position retained by said retaining mechanism; and a second linkage mechanism for transmitting of an operating displacement of said shift lever to said shift pedal to displace said shift pedal to a depressed position corresponding to said retaining position set by said shift lever and retained by said retaining mechanism;

wherein said shift lever, said retaining mechanism and said second linkage mechanism are attachable and detachable independently of said first linkage mechanism, such that said first linkage mechanism acts independently of said retaining mechanism and said second linkage mechanism.

2. A shift control system as defined in claim 1, wherein said second linkage mechanism includes a play-accommodating mechanism for permitting a depression of said shift pedal to a higher speed position than the retaining position retained by said retaining mechanism, said play-accommodating mechanism permitting said shift pedal to be depressed to said higher speed position, said retaining position retained by said retaining mechanism.

3. A shift control system as defined in claim 1, wherein said retaining mechanism, said shift lever and said second linkage mechanism are mounted on a support member attachable to and detachable from a body of said working vehicle, said the second linkage mechanism being connectable to said shift pedal.

4. A shift control system as defined in claim 1, wherein said stepless transmission is disposed between right and left body frames, said shift pedal being disposed laterally outwardly of said right body frame, said first linkage mechanism extending through said right body frame, said retaining mechanism and said shift pedal being interlocked through said second linkage mechanism laterally outwardly of said right body frame.

5. A shift control system as defined in claim 1, wherein:

said stepless transmission is steplessly shiftable forward and backward;

said shift pedal includes a forward pedal portion extending forward, and a rearward pedal portion extending rearward, said forward pedal portion being depressible to shift said stepless transmission for high forward speed, said rearward pedal portion being depressible to shift said stepless transmission for high backward speed; and said retaining mechanism is disposed rearwardly of said shift pedal, said second linkage mechanism interlocking said retaining mechanism and said rearward pedal portion.

6. A shift control system for a working vehicle having a propelling stepless transmission, comprising:

a shift pedal;

a first linkage mechanism for transmitting a downward displacement of said shift pedal to said stepless transmission to change a shift position of said stepless transmission;

a retaining mechanism for producing a retaining position corresponding to said shift position to retain said shift position of said stepless transmission;

a shift lever for setting said retaining position retained by said retaining mechanism; and a second linkage mechanism for transmitting of an operating displacement of said shift lever to said shift pedal to displace said shift pedal to a depressed position corresponding to said retaining position set by said shift lever and retained by said retaining mechanism;

wherein said retaining mechanism, said shift lever and said second linkage mechanism are mounted on a support member attachable to and detachable from a body of said working vehicle, said second linkage mechanism being connectable to said shift pedal.

7. A shift control system as defined in claim 6, wherein said shift lever, said retaining mechanism and said second linkage mechanism are attachable and detachable independently of said first linkage mechanism.

8. A shift control system as defined in claim 6, wherein said second linkage mechanism includes a play-accommodating mechanism for permitting a depression of said shift pedal to a higher seed position than the retaining position retained by said retaining mechanism, said play-accommodating mechanism permitting said shift pedal to be depressed to said higher speed position, said retaining position retained by said retaining mechanism.

9. A shift control system as defined in claim 6, wherein said stepless transmission is disposed between right and left body frames, said shift pedal being disposed laterally outwardly of said right body frame, said first linkage mechanism extending through said right body frame, said retaining mechanism and said shift pedal being interlocked through said second linkage mechanism laterally outwardly of said right body frame.

10. A shift control system as defined in claim 6, wherein:

said stepless transmission is steplessly shiftable forward and backward;

said shift pedal includes a forward pedal portion extending forward, and a rearward pedal portion extending rearward, said forward pedal portion being depressible to shift said stepless transmission for high forward speed, said rearward pedal portion being depressible to shift said stepless transmission for high backward speed; and said retaining mechanism is disposed rearwardly of said shift pedal, said second linkage mechanism interlocking said retaining mechanism and said rearward pedal portion.

* * * * *

UNITED STATES PATENT AND TRADEMARK OFFICE

CERTIFICATE OF CORRECTION

PATENT NO. : 6,347,560 B1
DATED : February 19, 2002
INVENTOR(S) :Kiyoshige Maezawa et al.

It is certified that error appears in the above-identified patent and that said Letters Patent is hereby corrected as shown below:

Column 8,
Line 31, "Figs. 6, and 8" should read -- Figs. 6, 7 and 8 --.

Column 9,
Line 6, "10A to 10B" should read -- 10A to 11B --.

Column 12,
Line 16, "higher seed" should read -- higher speed --.

Signed and Sealed this

Fourth Day of June, 2002

*Attest:*

*Attesting Officer*

JAMES E. ROGAN
*Director of the United States Patent and Trademark Office*